US005817997A

United States Patent [19]

Wernig

[11] Patent Number: 5,817,997

[45] Date of Patent: Oct. 6, 1998

[54] POWER SWITCH PLUNGER MECHANISM

[75] Inventor: Glenn Alan Wernig, San Jose, Calif.

[73] Assignee: Silicon Graphics, Inc., Mountain View, Calif.

[21] Appl. No.: 794,195

[22] Filed: Jan. 24, 1997

[51] Int. Cl.[6] ..... H01H 15/00; H01H 13/70; H01H 13/14

[52] U.S. Cl. ..... 200/16 R; 200/345; 200/520

[58] Field of Search ..... 200/5 A, 16 R, 200/16 C, 16 D, 341, 342, 345, 512, 517, 520; 400/490, 491.2, 495.1

[56] References Cited

U.S. PATENT DOCUMENTS

| | | | |
|---|---|---|---|
| 4,463,237 | 7/1984 | Kim | 200/340 |
| 4,527,030 | 7/1985 | Oelsch | 200/306 |
| 4,939,324 | 7/1990 | English et al. | 200/345 |

*Primary Examiner*—Michael L. Gellner
*Assistant Examiner*—Michael J. Hayes
*Attorney, Agent, or Firm*—Wagner, Murabito & Hao

[57] ABSTRACT

A switch and plunger mechanism which allows for simple, inexpensive and reliable actuation of a switch is disclosed. A plunger having two flanges and a plunger pin is disposed in an opening within a computer housing which includes angled surfaces. When the plunger is pushed in, the flanges press against the tapered surfaces so as to deflect each of the flanges inwardly. Continued movement of the plunger into the engaged position moves the plunger pin such that it engages the switch. As the plunger moves into the engaged position, changing contact surfaces between the plunger and the surfaces of the plunger receptacle causes an audible and tactile snap to be emitted. The movement of the plunger into the fully depressed position deflects the flanges so as to store potential energy. When the finger pressure is released from the plunger, the stored energy is released so as to straighten the flanges and push the plunger pin back into the fully extended position.

19 Claims, 12 Drawing Sheets

POWER SWITCH PLUNGER MECHANISM

TECHNICAL FIELD

The present claimed invention relates to the field of switches for electronic devices. More specifically, the present claimed invention relates to an improved plunger mechanism for engaging a switch for a computing device.

BACKGROUND ART

Prior art methods for activation of electronic devices such as computers typically involve using pressure switches which are mounted to the housing of the computer. This creates a problem when the housing is removed from the chassis of the computer. When the housing is removed from the chassis, the switch must be either detached from the housing or the wires leading to the switch must be manually disconnected by the user. Though connectors may be used to facilitate connection and disconnection of wiring associated with the switch, removal and replacement of the computer housing is still slow and time consuming due to the need to disconnect and connect the required connectors.

Another prior art design includes a switch which is operable through an opening in the housing. This type of switch is typically mounted to the outside of the chassis and is directly operable by the user through the opening in the housing. Typically membrane type switches are used in this type of design. However, these switches are short and they do not reliably operate in systems which include a removable housing because of the difficulty in accessing the switch through the housing. It is particularly difficult to engage this type of switch when housings that are thick are used. This type of switch can be accidentally activated while the housing is removed and it is difficult to protect while the housing is removed. In addition, this type of switch is difficult to protect with a shroud. Switches that protrude from a chassis are particularly vulnerable to damage while the housing is removed. Also, a switch that attaches to a chassis assembly and protrudes through a housing requires a large tolerance to locate the switch correctly without interference.

Alternatively, switches which are operable through a thin sheet formed in the housing have be used to turn computers and electrical devices on and off. The thin sheet deflects upon the application of pressure so as to either directly engage a switch or so as to engage an arm molded into the housing which contacts the switch. Typically, membrane switches are also used in this type of design. Direct engagement of the switch by the membrane is only effective in designs which have a very thin housing. Therefore, the use of an arm to contact the switch is more common. However, designs which use an arm to contact the switch do not operate reliably, particularly when thicker housings are used, because the deflection of the arm is radial and not linear, which sometimes causes the arm to miss the actuation surface of the switch.

As electromagnetic interference (EMI) regulatory requirements have become stricter, and since higher end computers generate a high amount of EMI, there is a need to design a computer having an on/off switch which will not violate EMI requirements. One prior art solution to the EMI problem is to use a chassis which includes EMI containment surfaces and to place most or all of the computer's electronic components within the chassis. However, when the switch is located within the chassis, the distance between the surface of the housing and the switch increases. Therefore, prior art designs such as the use of openings in the housing and thin membrane actuation mechanisms will not work.

One design which has overcome the limitations of other prior art designs uses a plunger mechanism for actuating a pressure switch located within the chassis. The plunger is located within the housing and is responsive to a spring assembly which returns the plunger to the fully extended position. In designs which include a bezel, the plunger mechanism may be located within the bezel. However, this prior art design requires the use of numerous parts including a metal spring assembly. Spring assemblies are expensive and they are difficult and costly to assemble. In addition, spring assemblies are not very reliable when metal and plastic parts are used in combination in a moving design since the plastic part becomes the sacrificial part. Consequently, when springs are used with plastic plungers, the spring can wear against the plunger causing functional problems over time. The plunger can become loose within the housing and design details could wear causing a malfunction. Furthermore, springs will often begin to squeak after time due to wear against mating parts and relaxation of the metal due to continuous usage. Since the spring of the spring assembly wears out quickly with repeated use, effective engagement and disengagement of the pressure switch is not assured over a long period of time.

What is needed is a computer design which can reliably actuate a switch located within the chassis of the computer. The computer design must include components which are easy to maintain and operate. In addition, the components must be inexpensive to manufacture and assemble. Furthermore, a design which will be reliable and which will maintain its original properties over time is required. The design should allow for easy removal and replacement of the housing. Components which are durable and which will not be damaged by repeated removal of the housing are required. In designs which use a bezel, durable components which will not be damaged by the repeated removal and replacement of the bezel are required.

DISCLOSURE OF THE INVENTION

The present invention meets the above needs with a plunger which engages a switch located within the computer chassis. The plunger fits into the bezel of the computer. Pressing the top surface of the plunger moves the plunger downward so as to actuate the switch located within the chassis. Plastic flanges on the plunger which are deflected by the operation of the plunger force the plunger back into its original position as they straighten.

A computer which includes a chassis and a power switch located within the chassis is disclosed. A housing which includes a bezel which is easily removable encloses the chassis. The bezel is formed of plastic and includes an opening designed to receive a plunger. A plunger fits within the opening in the bezel. The plunger is formed of injection molded plastic. The plunger operates upon the application of pressure to the top surface of the plunger. At rest, the plunger is in a fully extended position. When the top surface of the plunger is pressed, the plunger moves within the bezel towards the chassis. Upon pressing the plunger further, a pin attached to the plunger contacts the switch. As the plunger moves into the fully depressed position, the switch is operated and an audible and tactile "click" is emitted.

The plunger includes two flanges which deflect as a result of the movement of the plunger downward into the opening in the bezel, the flanges reaching maximum deflection as the plunger is pushed into the fully depressed position. Each flange includes two ribs which have a side surface and an engagement surface. Each engagement surface is at an angle to the side surface of each rib. As the plunger is depressed, each engagement surface slides against the angled surfaces within the opening in the bezel. The audible and tactile click is a result of the movement of the ribs such that the point of contact between the ribs and the angled surfaces within the opening in the bezel changes from the engagement surfaces to the side surfaces of each rib. The deflection of the flanges places the flanges in tension such that each rib exerts a force outwardly against the angled surfaces of the opening in the bezel. Potential energy is stored in each flange by the deflection of the flanges. When finger pressure is removed from the plunger after the switch has been activated, the stored energy is released, changing from potential energy to kinetic energy. As surfaces of each flange push against the angled surfaces within the opening in the bezel, the plunger begins to move back toward its fully extended position due to the kinetic energy. As the plunger moves outward farther, interaction takes place between the side surface of each rib and the angled surfaces within the opening in the bezel so as to move the plunger back until its energy is fully dissipated and the plunger is back in its fully extended position.

The plunger is inexpensive to manufacture as it is made of injection molded plastic. In addition, the plunger is easy to assemble into the bezel. The plunger is keyed for fool proof assembly. The only required step is the placement of the plunger into the opening in the bezel. As the plunger is placed into the opening in the bezel, snaps located on each flange engage slots located in the side of the opening in the bezel so as to lock the plunger into the bezel. A key of the plunger governs the inward linear distance of travel of the plunger. In addition, the key prevents the plunger from being incorrectly assembled. The two snaps govern the outward linear distance of travel of the plunger and they prevent the plunger from moving out of the opening in the bezel.

A plastic overmold is deposited over the top of the plunger head. The plastic overmold is formed of a softer plastic material such as Durometer 80A. The plastic overmold provides a soft rubbery feel to the top surface of the plunger. In addition, the plastic overmold covers two slots formed within the top of the plunger. These slots allow the flanges to easily flex and they reduce the stress within the plunger when the flanges are deflected. Though the plastic overmold is deposited within the slots, the plastic which is used is so soft that it easily compresses, allowing the flanges to flex and thereby preventing damage due to excess stress.

The present invention provides for consistent and reliable switch operation since there is a direct linear line from the top surface of the plunger to the switch. Thus, contact with the switch is assured. Since the only moving part other than the components of the switch itself is the plunger, and since the plunger is made of plastic, the present invention provides a mechanism which is durable and elastic. The components of the present invention are not under any load when at rest. Therefore, there is no creep in the material. In addition, since both the housing and the plunger are plastic, the friction between the parts is negligible.

The present invention does not require springs as do prior art designs which use a plunger. Though springs typically cost around 20 cents, the real cost savings is in the easy and fool proof assembly. Since the assembler does not have to insert any type of spring assembly, assembly is much easier than that of prior art designs which require springs. In addition, since springs are not required, the present invention is more reliable and easy to maintain than prior art designs. Moreover, since there is minimal friction between wearing surfaces, no squeaking or scraping sounds are generated over time.

The present invention allows for the easy removal and replacement of the bezel as there are no wires to disconnect and connect, there is no bulb or lens cover to disconnect and connect and there is no connector to deal with. There are no surfaces protruding from the bezel that can be damaged while the bezel is disconnected from the chassis. Furthermore, there are no surfaces protruding from the chassis that can be damaged while the bezel is removed from the chassis.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
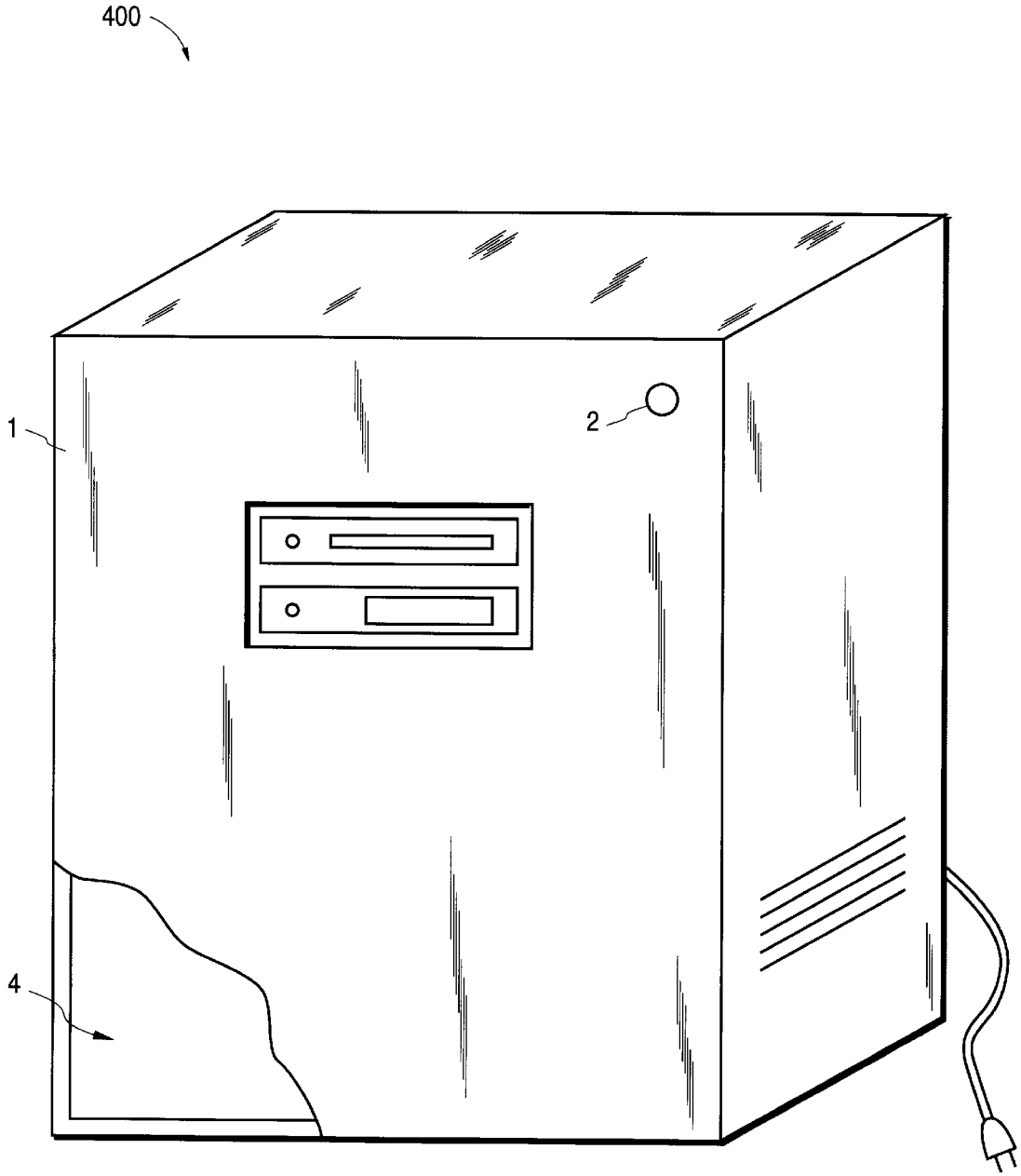
FIG. 1 is a cut-away front perspective view illustrating a computer including a plunger in accordance with the present invention.

With reference now to FIG. 1, computer 400 is shown to include a housing which includes bezel 1 and plunger 2. Bezel 1 encloses the chassis of computer 400. Plunger 2 fits within bezel 1. Plunger 2 is made of injection molded plastic. Plunger 2 may be pressed to operate switch 10 (not shown) so as to turn the computer on and off.

Figure 2:
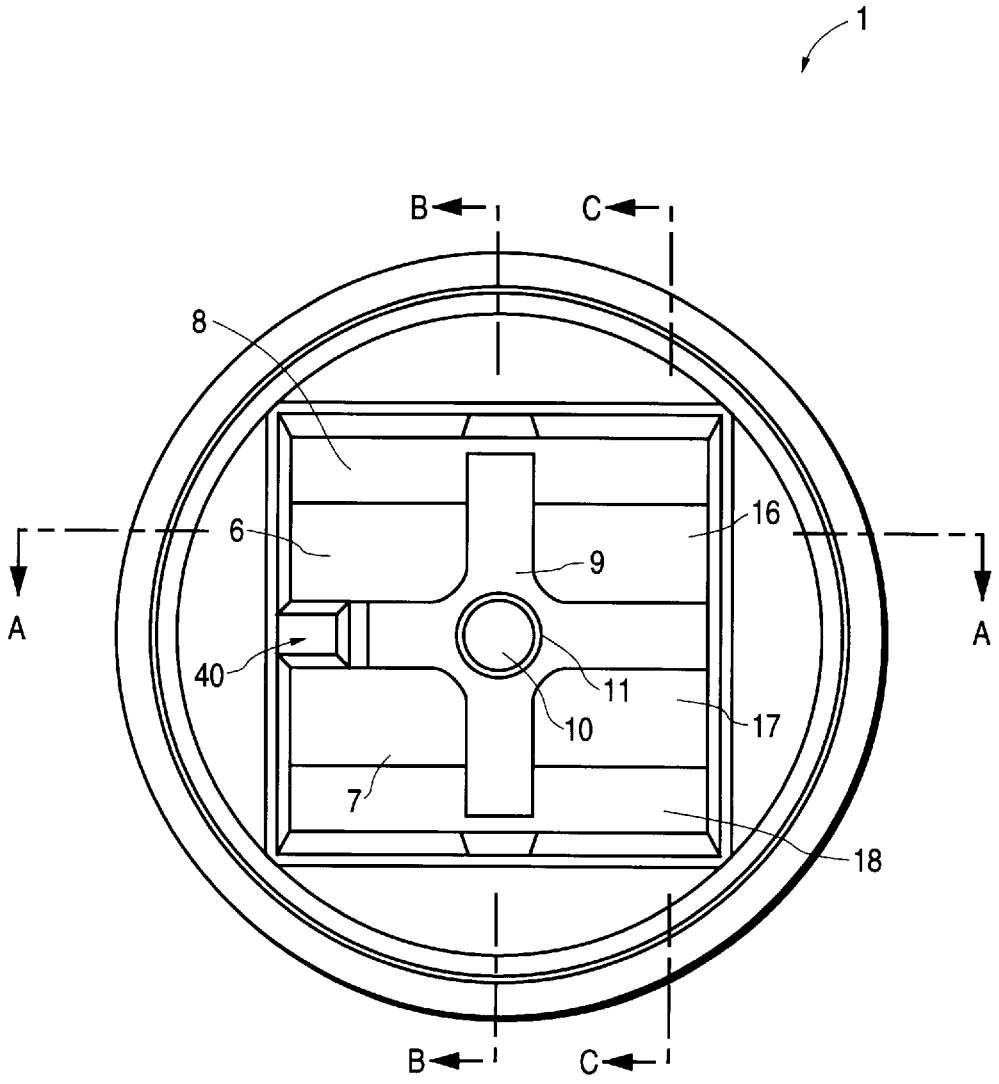
FIG. 2 is an expanded front view illustrating a computer with the plunger removed in accordance with the present invention.

FIG. 2 shows a front view of computer 400 with plunger 2 removed. Bezel 1 includes an opening which extends from the front of bezel 1 to receptacle end surface 9. Receptacle end surface 9 acts as a stop surface so as to limit the travel of plunger 2 (not shown). Keying rib 40 extends from receptacle end surface 9 so as to prevent the incorrect insertion of plunger 2. Slot 6 and slot 16 extend through one side of end surface 9. Angled surface 8 extends at a thirty degree angle from receptacle end surface 9. Angled surface 8 extends through slot 6 and slot 16. Similarly, slot 7 and slot 17 extend through the opposite side of receptacle end surface 9. Angled surface 18 extends downward at a thirty degree angle from receptacle end surface 9. Angled surface 18 extends through slot 7 and slot 17. Plunger pin guide opening 11 allows for access through bezel 1 to switch 10 which is connected to the internal circuitry of computer 400. Pin guide opening 11 holds the round plunger pin 27 (not shown) in line with switch 10 as it travels back and forth within a restricted range of motion.

Figure 3:
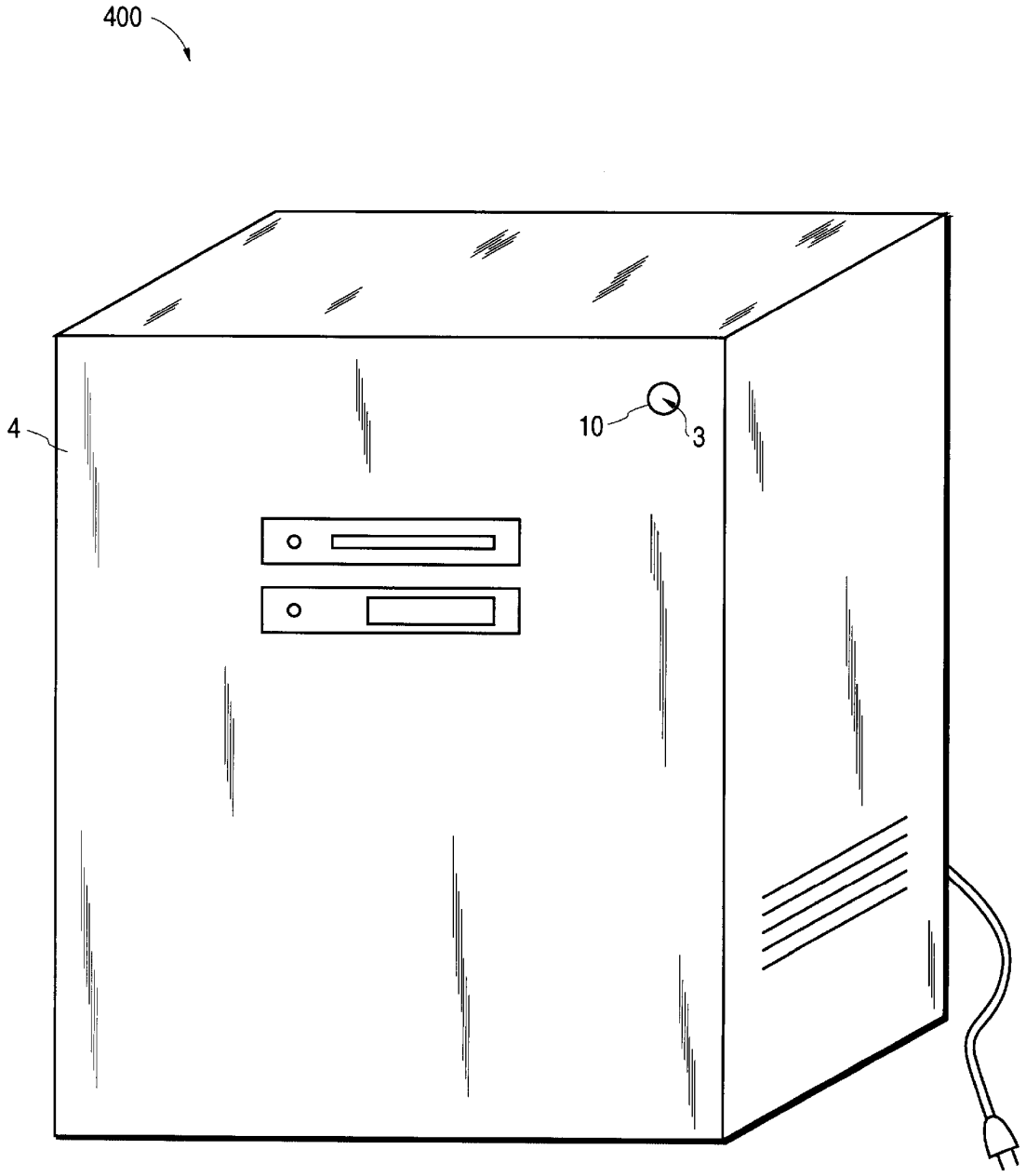
FIG. 3 is a front perspective view of a computer with the bezel removed in accordance with the present invention.

FIG. 3 shows a front view of computer 400 after bezel 1 has been removed. Chassis 4 encloses the electronic components of computer 400. Chassis 4 is formed from sheet metal so as to contain electromagnetic radiation (EMR). Chassis 4 includes opening 3 which exposes switch 10. The body of switch 10 is located inside of chassis 4. The reduction in EMR resulting from placing switch 10 inside chassis 4 with a minimum diameter access hole reduces the possibility of EMR radiating from computer 400. This is because chassis 4 shields EMR emanating from the electronics of computer 400 such that EMR is only emitted through the opening 3 and other openings such as openings for disk drives. Therefore, it is desirable to minimize the diameter of opening 3 to the minimum diameter required for clearance of those portions of switch 10 which may extend through opening 3 so as to limit the amount of EMR emanating from computer 400.

Figure 4:
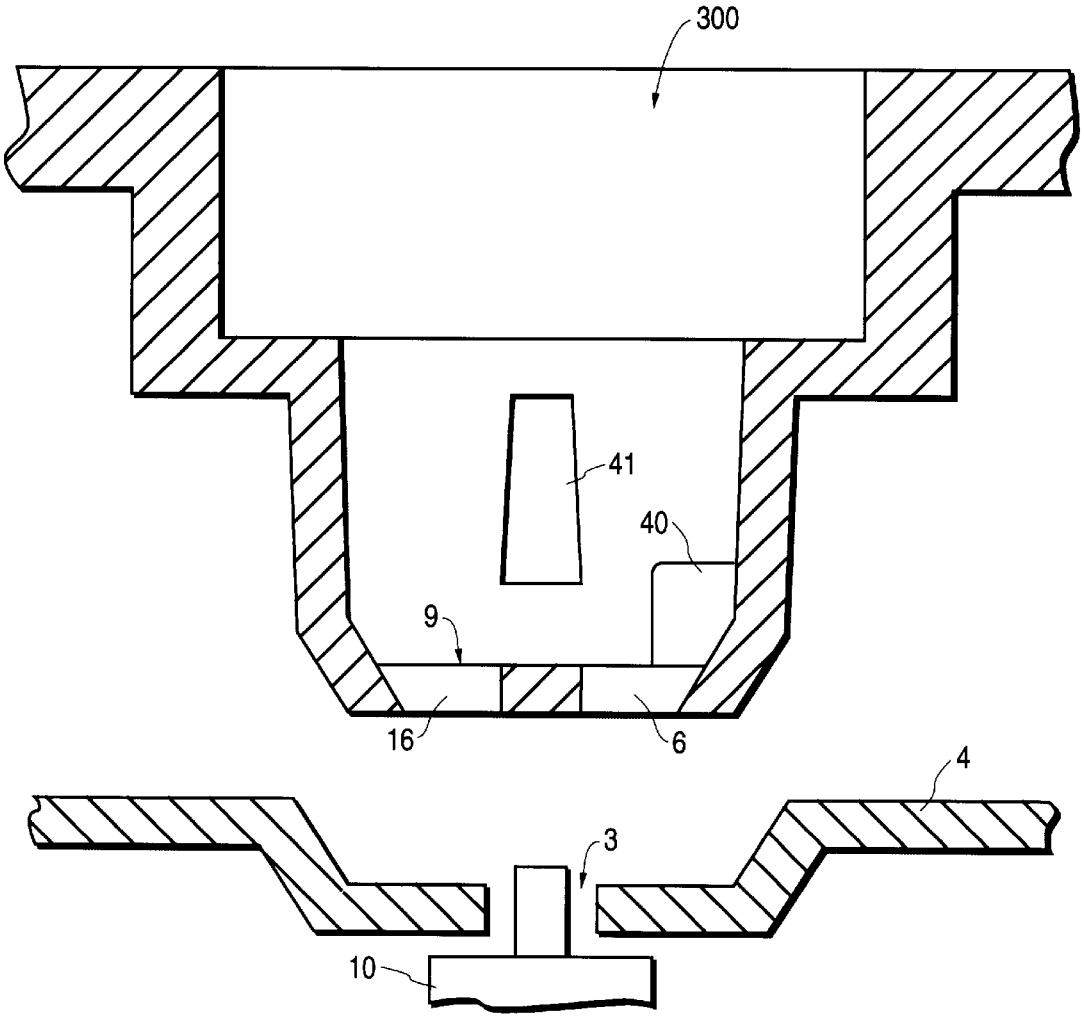
FIG. 4 is a expanded cross sectional view along axis A—A of FIG. 2 in accordance with the present invention.

FIG. 4 illustrates computer 400 with plunger 2 removed. Plunger receptacle 300 is formed within bezel 2. Plunger receptacle 300 is simply an opening in bezel 1 which includes plastic "surfaces" designed to receive plunger 2 (not shown). It can be seen that switch 10 is contained within chassis 4 so that only a small portion of switch 10 is exposed by opening 3 in chassis 4. Slot 6 and slot 16 extend through receptacle end surface 9. Slot 41 extends through the side surface of plunger receptacle 300. Slot 41 limits the movement of plunger 2. Receptacle end surface 9 also acts to limit the movement of plunger 2. Keyed rib 40 extends from end surface 9 and prevents the incorrect insertion of plunger 2.

Figure 5:
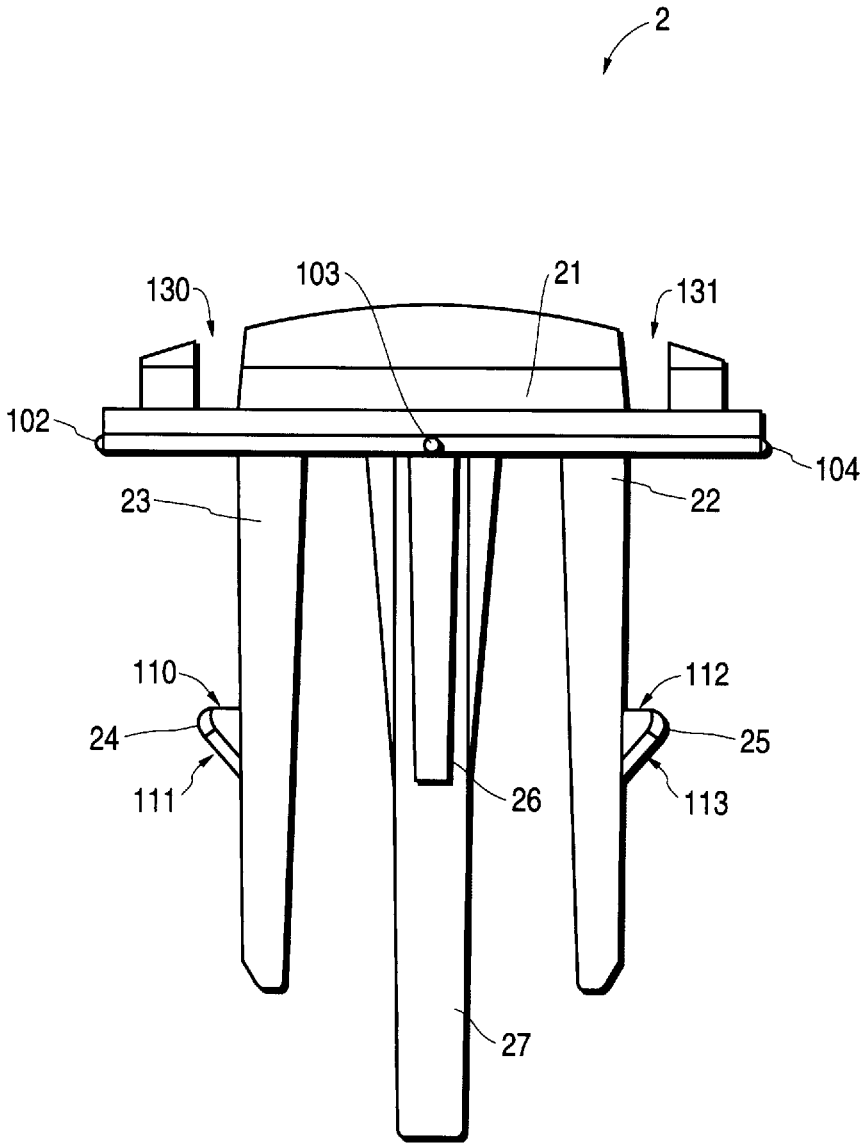
FIG. 5 is a front view of a plunger before the overmold is deposited in accordance with the present invention.

FIG. 5 illustrates a front view of plunger 2 with overmold 20 removed. Plunger 2 is preferably made of injection molded plastic. Button top 21 is rounded and has slot 130 and slot 131 formed in it. Slot 130 is aligned with the side surface of flange 23 and extends through plunger head 21 so as to allow flange 23 to easily flex. Similarly, slot 131 is aligned with the side surface of flange 22 and extends through plunger head 21 so as to allow flange 22 to easily flex. Plunger 2 includes flange 22 and flange 23 which extend from the bottom of plunger head 21. Snap 24 projects from flange 23 and snap 25 projects from flange 22. Snap 24 includes top surface 110 which prevents the removal of plunger 2 once plunger 2 is installed. Snap 25 includes top surface 112 which also prevents the removal of plunger 2 once plunger 2 is installed. Snap 24 includes angled surface 111 which is at an angle to top surface 110 and which is at a thirty degree angle from the side surface of flange 23 so as to allow for easy insertion of plunger 2. Snap 25 includes angled surface 113 which is at an angle to top surface 112 and which is at a thirty degree angle from the side surface of flange 22 so as to allow for easy insertion of plunger 2. Plunger pin 27 extends from the center of the bottom of plunger head 21. Key 26 extends from plunger pin 27 so as to make contact with keyed rib 40 (not shown) when plunger 2 is incorrectly inserted into plunger receptacle 300 (not shown) so as to prevent plunger 2 from being incorrectly inserted. In addition, key 26 has a length which limits the travel of plunger 2 once it is correctly inserted.

Figure 6:
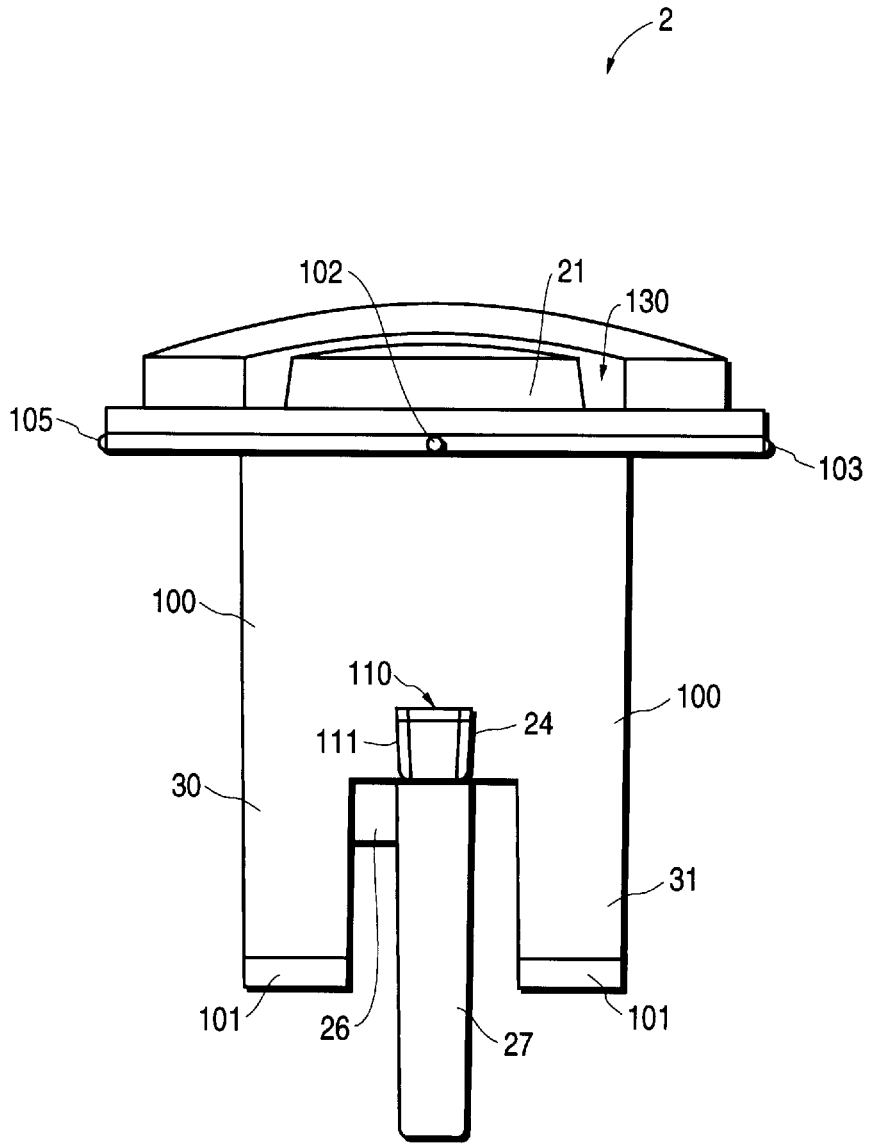
FIG. 6 is a side view of a plunger before the overmold is deposited in accordance with the present invention.

FIG. 6 shows a left side view of plunger 2 before overmold 20 is deposited. It can be seen that flange 23 extends from the bottom of plunger top 21 and includes rib 30 and rib 31. Each of ribs 30–31 includes a side surface 100 and a engagement surface 101. Engagement surface 101 is angled at a thirty degree angle from side surface 100. Key 26 extends from the bottom of plunger top 21 and connects to plunger pin 27. Snap 24 includes angled surface 111 that extends at an angle from top surface 110 of snap 24 to the side surface of flange 23.

Figure 7:
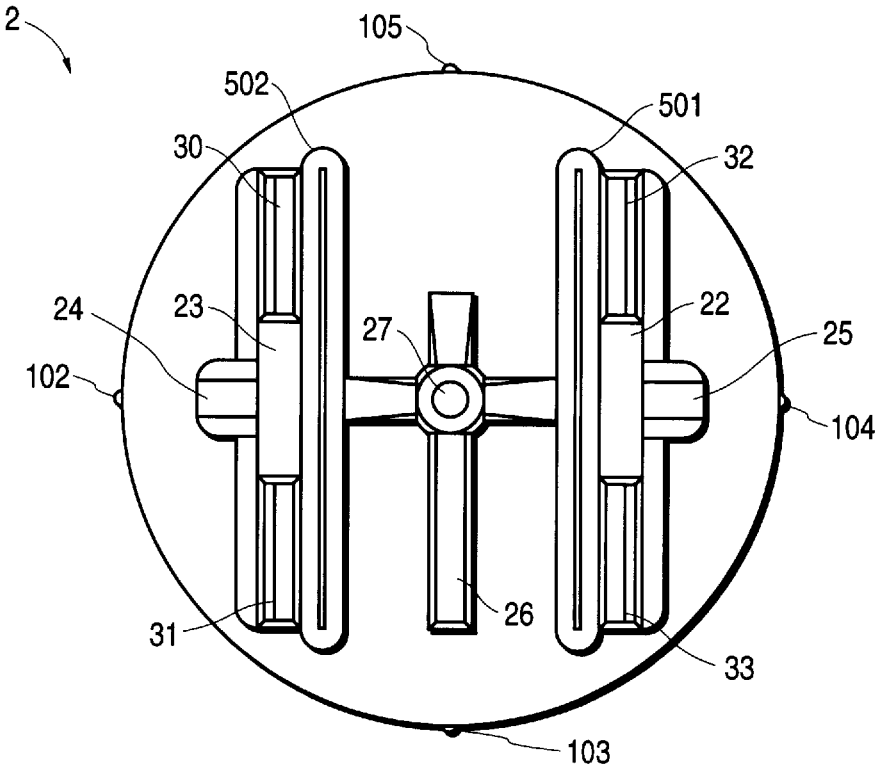
FIG. 7 is a bottom view of a plunger in accordance with the present invention.

FIG. 7 shows a bottom view of plunger 2 before overmold 20 is deposited. Flange 22 includes rib 32 and rib 33 which extend from either side of snap 25. Nipples 101–105 extend from the side of plunger top 21. Nipples 102–105 are molded at ninety degrees to one another and provide a 0.020 tall domed surface to provide guidance within the plunger receptacle 300 as plunger 2 travels forward and back. The domed surfaces of nipples 102–105 contact the wall of plunger receptacle 300 so as to minimize the friction between plunger 2 and the surfaces of plunger receptacle 300. In addition, the domed surfaces of nipples 102–105 keep plunger top 21 in a true linear travel and provide a smooth surface on which to interact with surfaces of plunger receptacle 300, recessed surface 501 and recessed surface 502 provide additional flexibility to the plunger.

Figure 8:
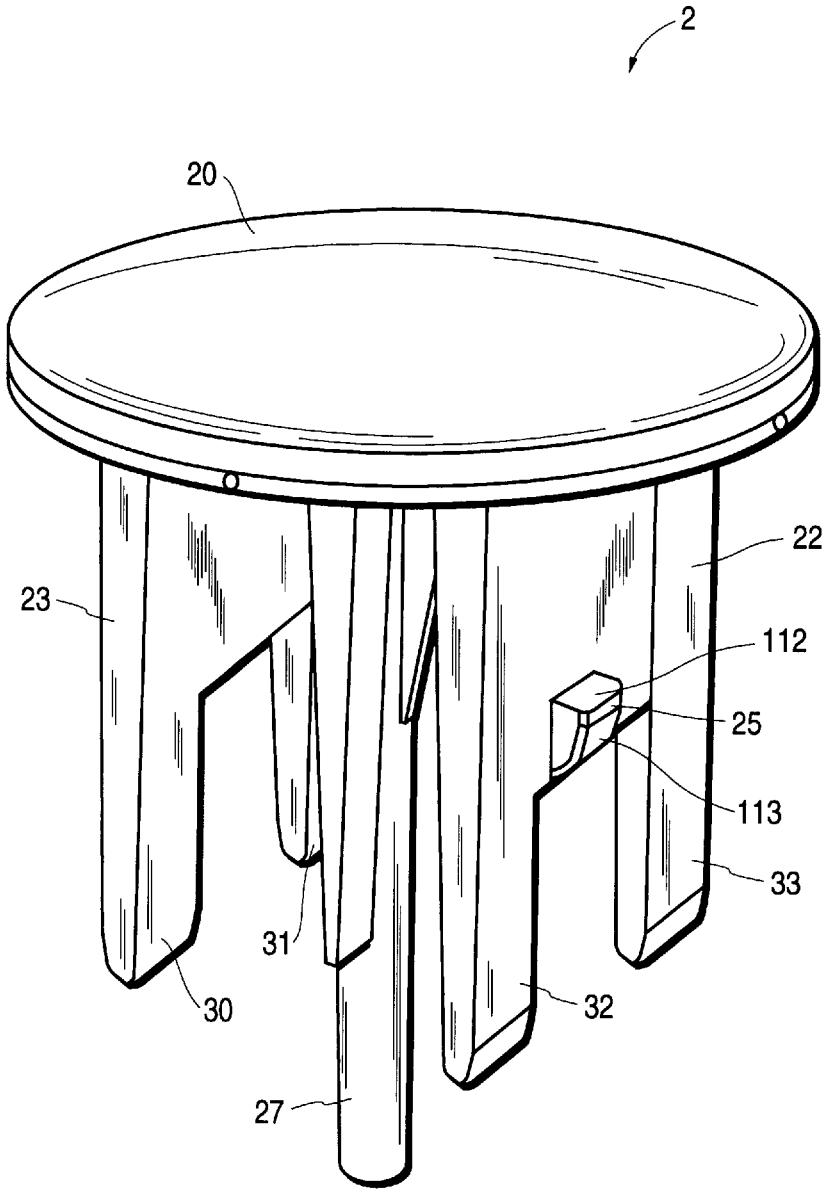
FIG. 8 is a perspective view of a plunger in accordance with the present invention.

FIG. 8 shows a perspective view of a plunger after plunger overmold 20 is deposited over plunger head 21. The shape of overmold 20 conforms to the shape of the surface of plunger head 21. Therefore, overmold 20 fills slot 130 and slot 131. However, since the material from which overmold 20 is made is soft plastic, the fact that overmold 20 fills slots 130–131 does not alter the stress reduction and the flexibility created by slots 130 and 131. Plunger overmold 20 is made from a soft plastic material which gives a "soft" feel to the plunger 2. In addition, the texture of plunger overmold 20 which is a fine MOLDTECH MT 11000 texture is a non-skid texture. Thus, in addition to covering slots 130–131 (not shown), overmold 20 provide a softer "feel" and a non-skid surface upon which to push with ones finger.

Figure 9:
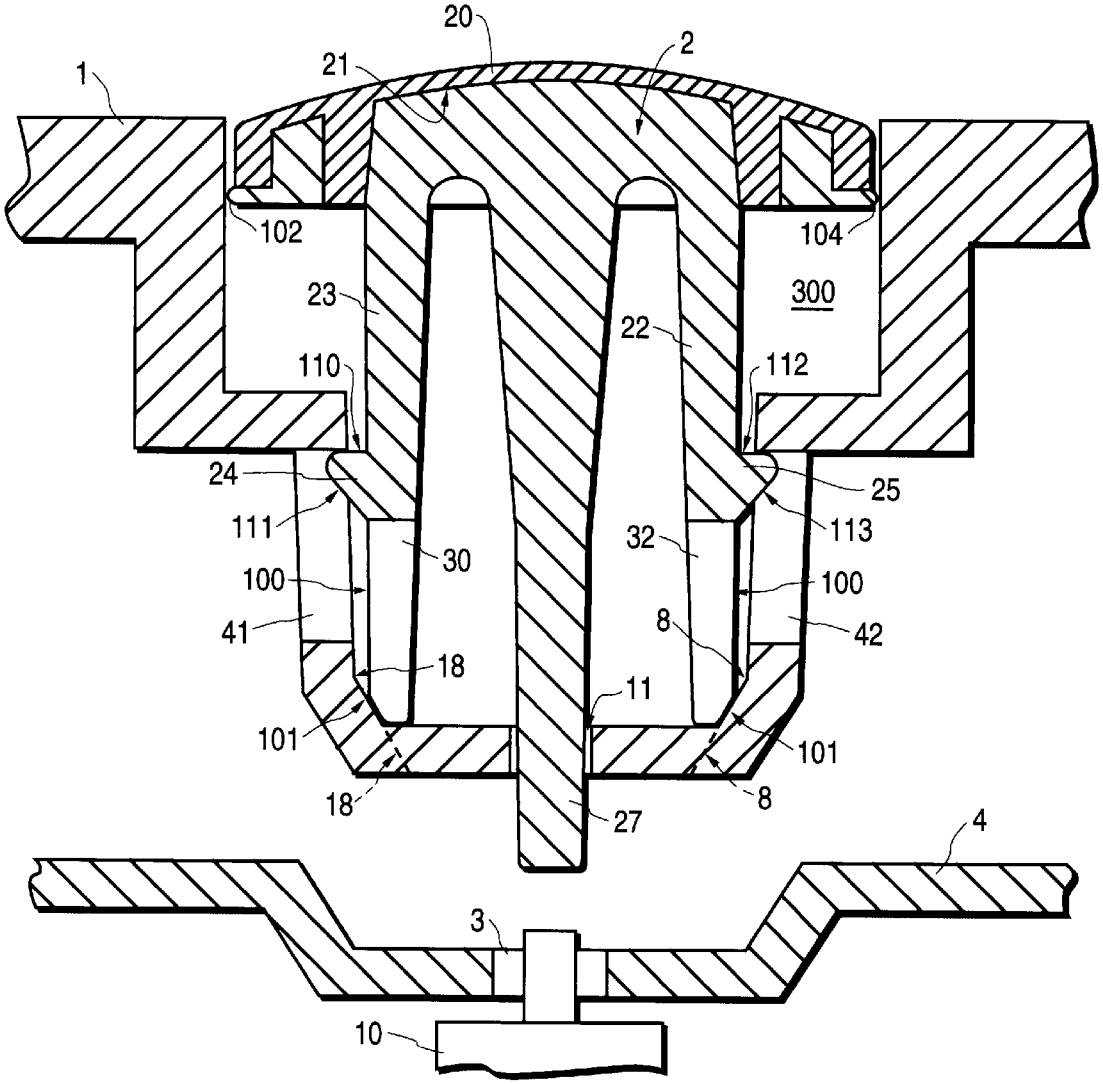
FIG. 9 is an expanded cross sectional view along axis B—B showing the plunger in the fully extended position in accordance with the present invention.

FIG. 9 shows plunger 2 in the fully extended position. In this position, plunger 2 is at rest and there is no potential energy stored within flanges 22–23. The angle at which angled surface 111 and angled surface 113 meet the side surfaces of plunger receptacle 300 allow plunger 2 to be easily inserted into plunger receptacle 300. However, once plunger 2 is inserted such that snap 24 engages slot 41 and snap 25 engages slot 42 (not shown), the plunger is locked into housing 1. This locking mechanism results from the contact of top surface 112 of snap 25 with the top of slot 42 and the contact of top surface 110 of snap 24 with the top of slot 41. The locking mechanism prevents plunger 2 from sliding out of bezel 1. Rib 30 projects from flange 23 and rib 32 projects from flange 22. Engagement surface 101 of rib 30 and engagement surface 101 of rib 32 are at a thirty degree angle from side surface 100 of rib 30 and side surface 100 of rib 32. Therefore, engagement surface 101 of rib 30 aligns with angled surface 18 and engagement surface 101 of rib 32 aligns with angled surface 8. Plunger pin 27 fits within plunger pin guide opening 11. Plunger pin 27 is aligned with opening 3 in chassis 4. Nipples 102 and 104 extend from plunger 2 such that only they contact the side surfaces of plunger receptacle 300.

Figure 10:
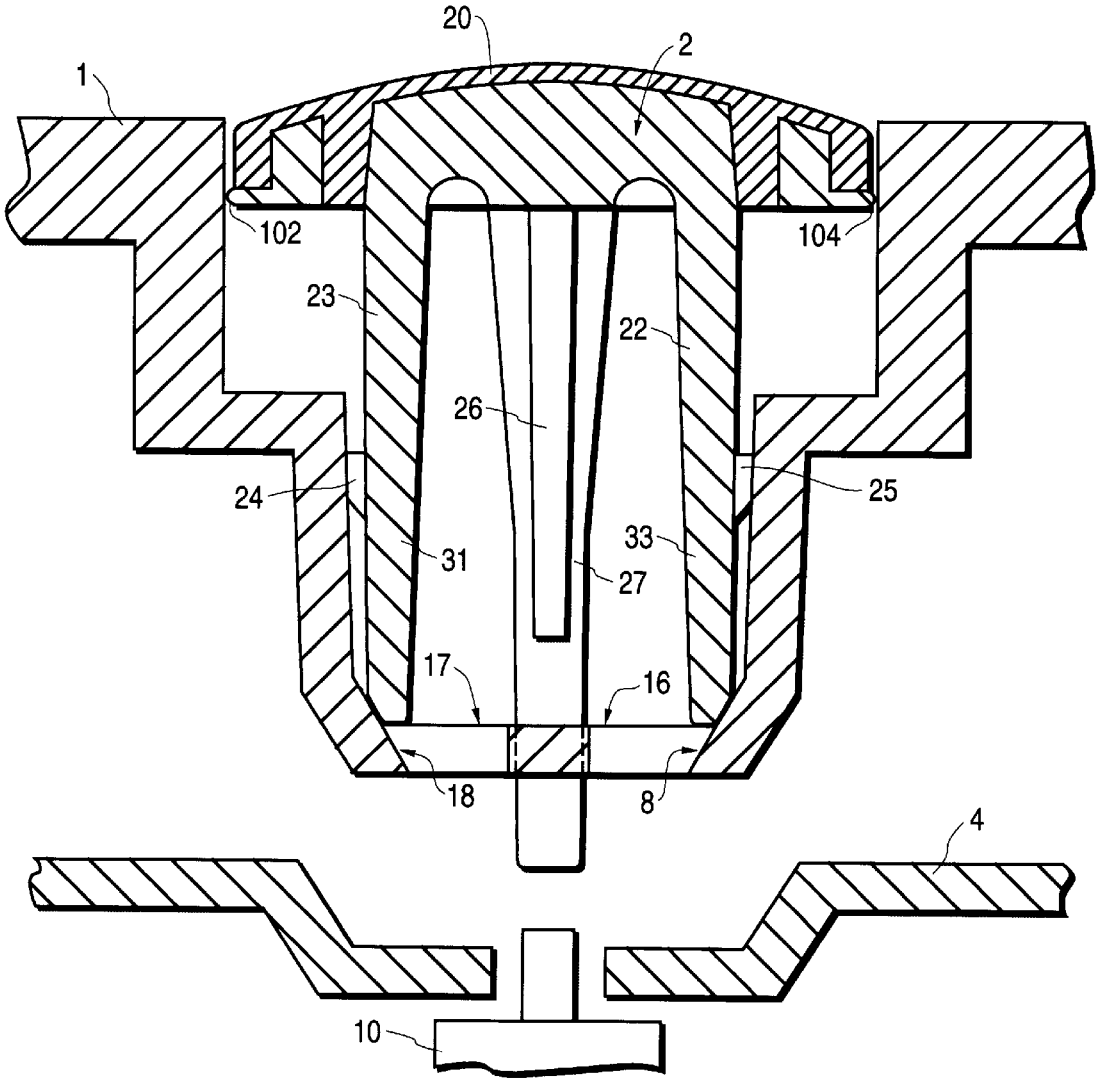
FIG. 10 is an expanded cross sectional view along axis C—C of FIG. 2 with the plunger inserted showing the plunger in the fully extended position in accordance with the present invention.

FIG. 10 shows plunger 2 inserted into bezel 1 and in the fully extended position. In this position, rib 31 of flange 23 makes contact with angled surface 18 and rib 33 of flange 22 makes contact with angled surface 8. Engagement surface 101 of rib 31 is angled at a thirty degree angle so that it adjoins angled surfaces 18 and engagement surface 101 of rib 33 is angled at a thirty degree angle so that it adjoins angled surface 8. Slot 16 and slot 17 extend immediately below rib 31 and rib 33 such that, upon the application of pressure to plunger 2, rib 31 and rib 33 may move into slot 16 and slot 17.

Figure 11:
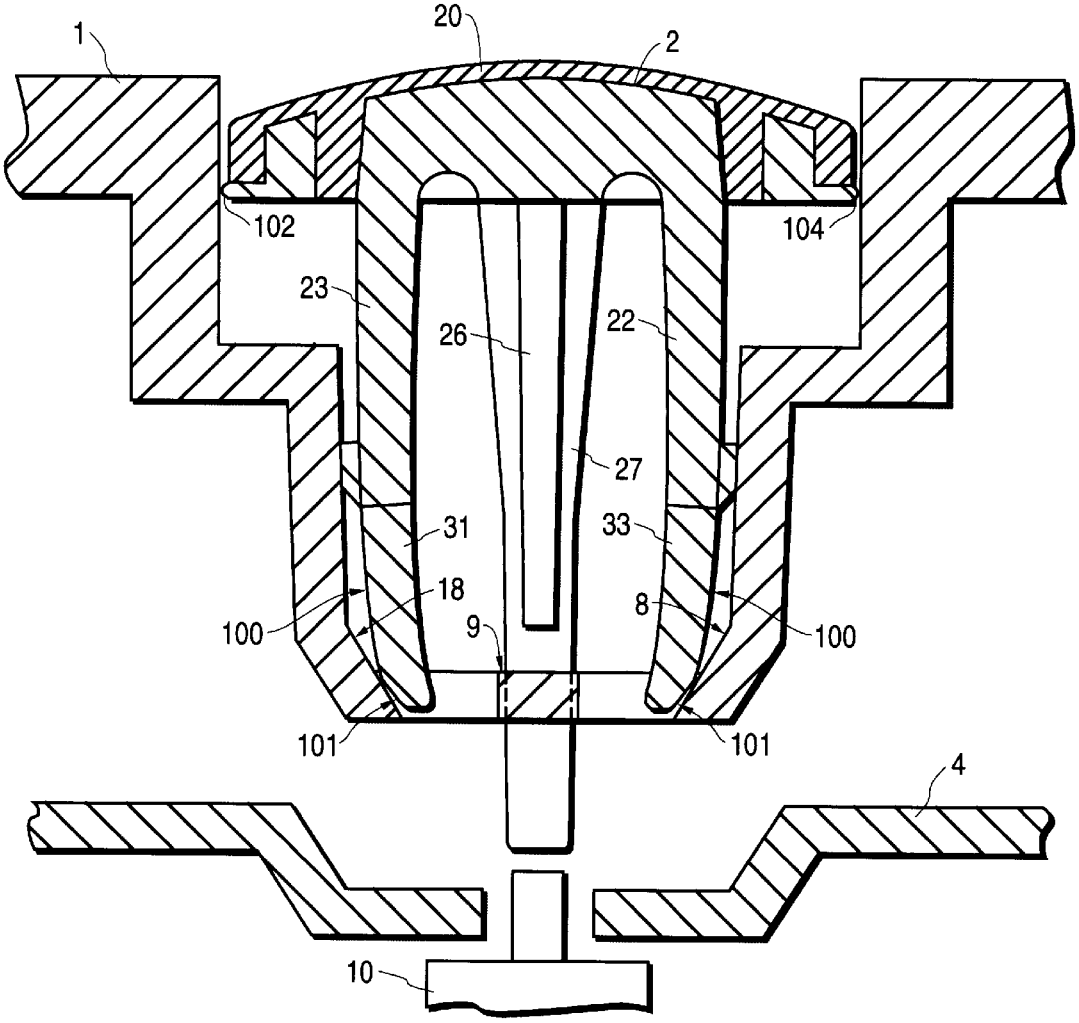
FIG. 11 is an expanded cross sectional view along axis C—C of FIG. 2 with the plunger inserted showing the plunger in the half-depressed position in accordance with the present invention.

FIG. 11 shows a cross section at Axis C—C of FIG. 2 illustrating plunger 2 half way extended. As plunger 2 is pressed inwardly, engagement surfaces 101 of ribs 30–33 (ribs 30 and 32 are not shown) move into slots 6–7 (not shown) and 16–17. Thus, engagement surface 101 of rib 31 slides downward on angled surface 18 and engagement surface 101 of rib 33 slides downward across angled surface 8. The angle at which angled surface 8 and angled surface 18 taper inwardly causes flanges 22–23 to bend inwardly as ribs 31 and 33 are forced inwardly. Similarly, the engagement surfaces of rib 30 and rib 32 contact angled surface 8 and angled surface 18 so as to cause flanges 22–23 to bend. The bending of flanges 22–23 causes potential energy to be stored within flanges 22–23. The amount of potential energy stored within flanges 22–23 increases as the deflection increases. Plunger pin 27 moves inward and approaches switch 10 as plunger 2 is pressed in. The length of key 26 is such that the end of key 26 has not contacted end surface 9. Therefore, the plunger may continue to move inward until such time as key 26 contacts end surface 9.

As plunger 2 is pressed further, engagement surface 101 of rib 31 continues to slide downward on angled surface 18 and the engagement surface 101 of rib 33 continues to slide downward on angled surface 8. The angle at which angled surface 8 and angled surface 18 taper inwardly causes flanges 22–23 to further deflect as ribs 30–33 are forced towards each other. As plunger 2 reaches the fully depressed position, the bottom of key 26 strikes receptacle end surface 9, preventing further movement of plunger 2.

Figure 12:
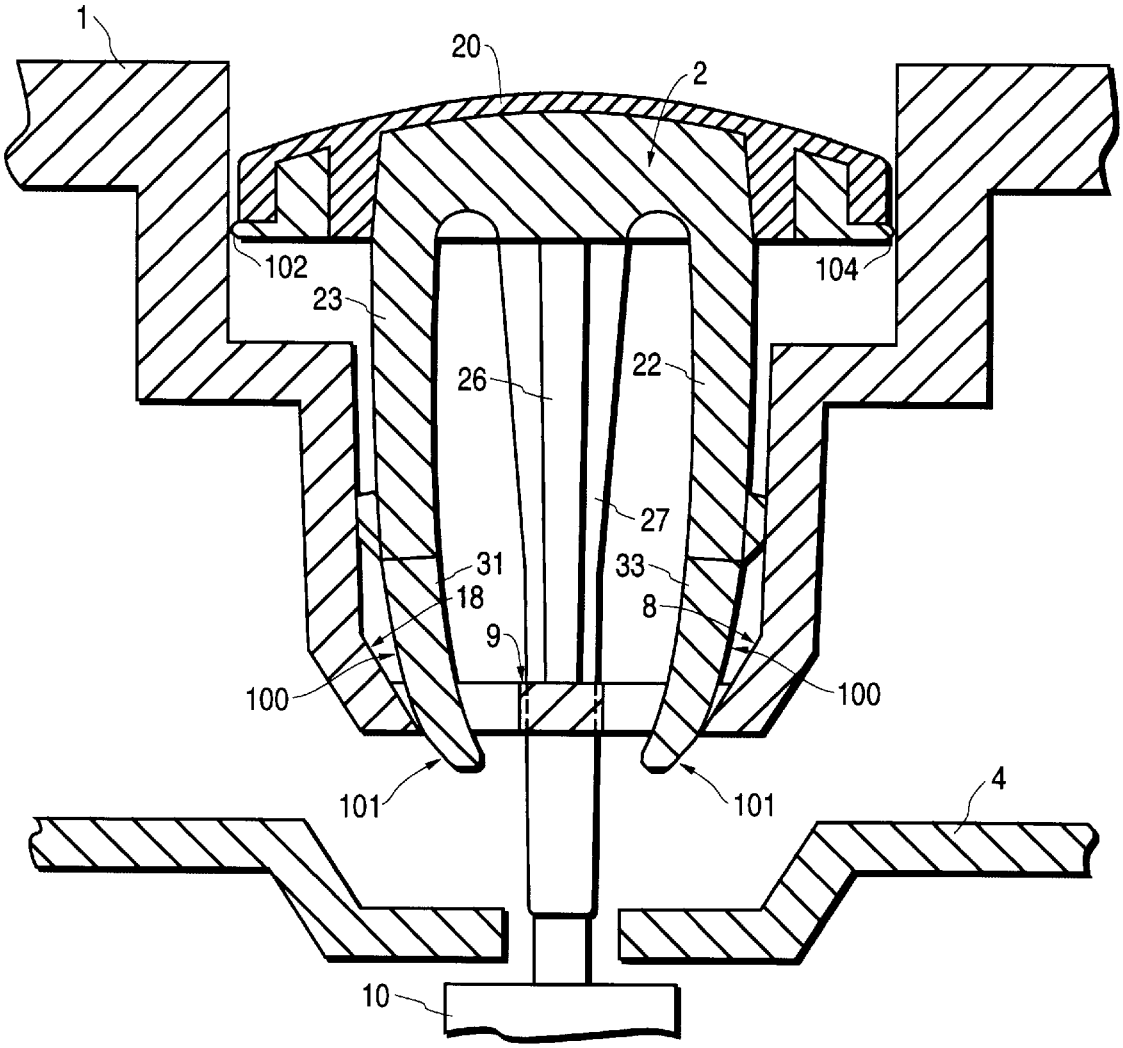
FIG. 12 is an expanded cross sectional view along axis C—C of FIG. 2 with the plunger inserted and showing the plunger in the fully depressed position in accordance with the present invention.

FIG. 12 shows plunger 2 in the fully depressed position. The movement of plunger 2 into the fully depressed position engages switch 10. In the fully depressed position, the bottom of key 26 strikes receptacle end surface 9. Flanges 22–23 are at their maximum deflection. The total travel distance that the plunger 2 moves from its initial fully extended position to its fully depressed position is 0.150 inches. The total travel distance that the switch 10 moves from its initial fully extended position to its fully depressed position is 0.025 inches. An audible and tactile snap occurs as the contact between rib 31 and rib 33 and angled surfaces 8 and 18 move from interaction surfaces 101 to side surfaces 100. Simultaneously, an audible and tactile snap is generated by rib 30 (not shown) and rib 32 (not shown) as the contact with angled surface 8 and 18 moves from contact with interaction surfaces 101 to side surfaces 100.

Potential energy is now stored in flanges 22–23 such that when finger pressure is removed from plunger 2 after switch 10 has been activated, stored energy is released. Surfaces 100 of ribs 30–33 push back against angled surface 8 and 18 and plunger 2 begins to move back toward its extended position. As plunger 2 moves back farther, interaction takes place between surfaces 101 and angled surface 8 and angled surface 18 so as to move plunger 2 back until its energy is fully dissipated and plunger 2 is back in its fully extended position.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A switching mechanism for a computer comprising;

a switch disposed within an enclosure having an opening formed therein, said switch disposed adjoining said opening such that said switch may be activated through said opening;

a housing disposed around said enclosure, said housing including a plunger receptacle having a plurality of angled surfaces and a plunger pin opening; and a plunger disposed within said plunger receptacle, said plunger including a plunger head, a plunger pin and a plurality of flanges, said plunger pin extending from said plunger head such that said plunger may be pressed so as to move said plunger pin through said plunger pin opening such that said plunger pin engages said switch, said flanges contacting said angled surfaces of said plunger receptacle such that, said plunger may move within said plunger receptacle from a fully extended position to a fully depressed position, such that said plunger may be pressed so as to move said plunger from said fully extended position to said fully depressed position and wherein said force exerted by said flanges against said angled surfaces moves said plunger back into said fully extended position.

2. The switching mechanism for a computer of claim 1 wherein said plunger includes two snaps and wherein said plunger receptacle includes two slots disposed so as to receive said snaps such that said snaps move within said slots so as to limit the movement of said plunger within said plunger receptacle.

3. The switching mechanism for a computer of claim 2 wherein said plunger includes a key having a length and wherein said plunger receptacle includes an end surface such that, upon pressing said plunger such that said plunger moves into said fully depressed position, said key contacts said end surface so as to prevent the further movement of said plunger into said plunger receptacle.

4. The switching mechanism for a computer of claim 3 wherein said plunger includes a first flange and a second flange and wherein said angled surfaces of said plunger receptacle are disposed so as to deflect said first flange towards said second flange upon the movement of said plunger into said plunger receptacle.

5. The switching mechanism for a computer of claim 4 wherein said plunger and said housing are made of plastic.

6. The switching mechanism for a computer of claim 5 wherein said plunger includes a first flange and a second flange and wherein a first rib and a second rib extend from a first flange and wherein a third rib and a fourth rib extend from said second flange, each of said ribs including a side surface and an engagement surface.

7. The switching mechanism for a computer of claim 6 wherein said plunger receptacle includes four angled surfaces which receive said ribs, each of said engagement surfaces of said ribs engaging one of said angled surfaces such that said plunger easily moves within said plunger receptacle.

8. The switching mechanism for a computer of claim 7 wherein said ribs and said angled surfaces are disposed such that, upon the movement of said plunger into said fully depressed position, each of said angled surfaces contacts each of said side surfaces of said ribs so as to generate an audible clicking sound.

9. A switching mechanism for a computer comprising;

a chassis including a chassis opening;

a housing disposed around said chassis, said housing having a plunger receptacle including a plurality of angled surfaces, and a plunger pin opening;

a switch disposed within said chassis such that said switch may be activated through said chassis opening;

a plunger disposed within said plunger receptacle, said plunger including a first snap, a plunger head, a plunger pin and a plurality of flanges, said first snap engaging said plunger receptacle so as to limit the movement of said plunger within a limited range within said plunger receptacle, said plunger pin extending from said plunger head such that said plunger may be pressed so as to move said plunger pin through said plunger pin opening such that said plunger pin engages said switch, said flanges contacting said angled surfaces of said plunger receptacle such that, upon the movement of said plunger into said plunger receptacle, said flanges deflect so as to exert a force against said angled surfaces of said plunger receptacle so as to move said plunger outward within said plunger receptacle.

10. The switching mechanism for a computer of claim 9 wherein said plunger may move within said plunger receptacle from a fully extended position to a fully depressed position such that said plunger may be pressed so as to move said plunger from said fully extended position to said fully depressed position and wherein said force exerted by said flanges against said angled surfaces moves said plunger into said fully extended position.

11. The switching mechanism for a computer of claim 10 wherein said plunger further comprises a second snap and wherein said plunger receptacle further comprises a plurality of slots disposed so as to receive said first snap and said second snap such that said first snap and said second snap may move within said slots so as to limit the movement of said plunger within said plunger receptacle.

12. The switching mechanism for a computer of claim 11 wherein said plunger includes a key having a length such that, upon pressing said plunger such that said plunger moves into said fully depressed position, said key contacts said plunger receptacle so as to prevent the further movement of said plunger into said plunger receptacle.

13. The switching mechanism for a computer of claim 12 wherein said plunger comprises plastic.

14. The switching mechanism for a computer of claim 12 wherein said housing comprises plastic.

15. The switching mechanism for a computer of claim 12 wherein said plunger includes a first flange and a second flange and wherein a first rib and a second rib extend from said first flange and wherein a third rib and a fourth rib extend from said second flange, each of said ribs including a side surface and an engagement surface such that, upon the movement of said plunger into said plunger receptacle, said first flange is deflected towards said second flange such that said engagement surfaces of said ribs exert a force against said angled surfaces so as to force said plunger outward.

16. The switching mechanism for a computer of claim 15 wherein said plunger receptacle includes four angled surfaces which receive said ribs, each of said engagement surfaces of said ribs engaging one of said angled surfaces such that said plunger easily moves within said plunger receptacle.

17. The switching mechanism for a computer of claim 16 wherein said ribs and said angled surfaces are disposed such that, upon the movement of said plunger into said fully depressed position, each of said angled surfaces contacts each of said side surfaces of said ribs so as to generate an audible clicking sound.

18. A plunger assembly for a switch mechanism comprising:

a plunger receptacle having a side surface including a first slot and a second slot, and an end surface including a first slot, a second slot, a third slot and a fourth slot;

a plunger top including a top surface;

a first flange, said first flange extending downward from said plunger top, said first flange including a first rib and a second rib, said first rib and said second rib having an engagement surface and a side surface, said engagement surface disposed at an angle from said side surface;

a second flange, said second flange extending downward from said plunger top, said second flange including a third rib and a fourth rib, said third rib and said fourth rib having an engagement surface and a side surface, said engagement surface disposed at an angle from said side surface;

a first snap attached to said first flange, said first snap having a top surface and a side surface, said side surface at an angle to said top surface so as to extend from said top surface of said snap to said outer surface of said first flange;

a second snap attached to said second flange, said second snap having a top surface and a side surface, said side surface of said second snap at an angle to said top surface so as to extend from said top surface of said snap to said second flange; and a plunger pin, said plunger pin extending downward from said plunger top such that said plunger pin may be inserted into said plunger receptacle such that said first snap and said second snap engage said first slot and said second slot of said plunger receptacle so as to prevent said plunger from disengaging from said plunger receptacle, and wherein said plunger may be pressed such that said plunger pin extends from said end surface, said first rib extending through said first slot and said second rib extending through said second slot, said third rib extending through said third slot and said fourth rib extending through said fourth slot so as to deflect said first flange and said second flange and so as to exert a force against the surfaces of said first slot and said second slot and said third slot and said fourth slot, and wherein, said force against said first slot and said second slot and said third slot and said fourth slot forces said plunger to slide outward within said plunger receptacle.

19. The plunger assembly for a switch mechanism of claim 18 wherein said plunger is made of plastic.

* * * * *